US011828500B2

(12) United States Patent
Kontu et al.

(10) Patent No.: US 11,828,500 B2
(45) Date of Patent: Nov. 28, 2023

(54) EVAPORATOR WITH IMPROVED DROPLET SEPARATION

(71) Applicant: VAHTERUS OY, Kalanti (FI)

(72) Inventors: Mauri Kontu, Kalanti as. (FI); Reima Viinikkala, Lokalahti (FI)

(73) Assignee: VAHTERUS OY, Kalanti (FI)

( * ) Notice: Subject to any disclaimer, the term of this patent is extended or adjusted under 35 U.S.C. 154(b) by 293 days.

(21) Appl. No.: 17/284,382

(22) PCT Filed: Oct. 10, 2019

(86) PCT No.: PCT/EP2019/077470
§ 371 (c)(1),
(2) Date: Apr. 9, 2021

(87) PCT Pub. No.: WO2020/074637
PCT Pub. Date: Apr. 16, 2020

(65) Prior Publication Data

US 2021/0389031 A1 Dec. 16, 2021

(30) Foreign Application Priority Data

Oct. 12, 2018 (EP) ..... 18200129

(51) Int. Cl.
*F28D 9/00* (2006.01)
*F28D 21/00* (2006.01)
*F25B 39/02* (2006.01)

(52) U.S. Cl.
CPC ..... *F25B 39/022* (2013.01); *F28D 9/0006* (2013.01); *F28D 21/0017* (2013.01);
(Continued)

(58) Field of Classification Search
CPC ..... B01D 1/305; F25B 39/02; F25B 39/022; F25B 2339/0241; F28D 9/0006; F28D 9/0043; F28D 21/0017; F28D 2021/0071
See application file for complete search history.

(56) References Cited

U.S. PATENT DOCUMENTS 9,366,464 B2 6/2016 Sonninen et al.
2005/0039486 A1* 2/2005 Knoll ..... F28D 9/0043 62/515

(Continued)

FOREIGN PATENT DOCUMENTS

CN 103477164 12/2013
CN 104334983 2/2015

(Continued)

OTHER PUBLICATIONS

Extended European Search Report for EP Application No. 18 200 129.7 dated Apr. 12, 2019, 5 pages.

(Continued)

*Primary Examiner* — Eric S Ruppert
*Assistant Examiner* — Hans R Weiland
(74) *Attorney, Agent, or Firm* — NIXON & VANDERHYE P.C.

(57) ABSTRACT

An evaporator (1) for vaporizing a substance into its gaseous form, which comprises at least a plate pack (4) functioning as an evaporator and a droplet separator arranged inside the outer casing. An outlet connection (6) for leading the vaporised substance out from the outer casing is arranged to an end plate of outer casing, and said outlet connection (6) is connected to a suction duct (10) arranged inside the outer casing in a longitudinal direction of the shell, and said suction duct (10) comprises openings (12) at the upper surface of the suction duct, wherein the droplet separator is constructed at both sides of the suction duct (10).

12 Claims, 3 Drawing Sheets

(52) U.S. Cl.
CPC .... *F25B 2339/0241* (2013.01); *F28D 9/0043* (2013.01); *F28D 2021/0071* (2013.01)

(56) References Cited

U.S. PATENT DOCUMENTS

| | | | | |
|---|---|---|---|---|
| 2008/0041096 | A1 | 2/2008 | Sakashita et al. | |
| 2013/0319039 | A1* | 12/2013 | Sonninen | B01D 1/305 62/515 |
| 2015/0114817 | A1 | 4/2015 | Kontu | |
| 2017/0254573 | A1* | 9/2017 | Numata | F25B 39/028 |
| 2018/0299172 | A1* | 10/2018 | Hartfield | F28D 21/0017 |
| 2019/0282919 | A1* | 9/2019 | Sonninen | B01D 1/0094 |

FOREIGN PATENT DOCUMENTS

| | | |
|---|---|---|
| CN | 107110575 | 8/2017 |
| EP | 1 870 647 | 12/2007 |

OTHER PUBLICATIONS

International Search Report and Written Opinion of the ISA for PCT/EP2019/077470 dated Jan. 7, 2020, 13 pages.
CN Official Action, CN Appln No. 201980067103.0 dated May 30, 2022.

* cited by examiner

EVAPORATOR WITH IMPROVED DROPLET SEPARATION

This application is the U.S. national phase of International Application No. PCT/EP2019/077470 filed Oct. 10, 2019 which designated the U.S. and claims priority to EP Patent Application No. 18200129.7 filed Oct. 12, 2018, the entire contents of each of which are hereby incorporated by reference.

FIELD OF THE INVENTION

The present invention relates to an evaporator and use of the evaporator according to the independent claims presented below.

BACKGROUND OF THE INVENTION

Evaporators are devices used to turn the liquid form of a substance into its gaseous form. One kind of evaporators known in the prior art comprise the plate pack functioning as an evaporator and the droplet separator fitted inside the same outer casing. The plate pack is arranged in lower part of the outer casing and the droplet separator is arranged above the plate pack. One important application of plate heat exchangers is a flooded evaporator, which may be used in vapor-compression refrigeration cycle in refrigerating machinery. The task of the droplet separator is to ensure that refrigerant droplets are not carried to the compressor of the refrigerating machinery.

In known evaporators, the outlet of the vaporised substance is commonly arranged above the droplet separator for ensuring uniform suction through the droplet separator and so efficient separation of the droplets. The outlet arranged above the droplet separator increases a space required for the evaporator arrangement in a height direction.

SUMMARY OF THE INVENTION

It is an object of the present invention to provide a structure of the evaporator which decreases a space required for the evaporator, especially in a height direction.

It is an object of the present invention to provide a structure of a flooded evaporator with a droplet separator, which is functionally efficient, economical and small in size. Especially, it is an object of the present invention to provide an evaporator which may require less space for pipework when adapting the evaporator in a system of the application.

In order to achieve among others the objects presented above, the invention is characterized by what is presented in the characterizing parts of the enclosed independent claims.

Some preferred embodiments of the invention will be described in the other claims.

The embodiments and advantages mentioned in this text relate, where applicable, both to the evaporator and the use of the evaporator according to the invention, even though it is not always specifically mentioned.

A typical evaporator according to the invention for vaporizing a substance into its gaseous form, which comprises at least

- an outer casing, which comprises a substantially horizontal shell and substantially vertical first end plate and second end plate,
- an inlet connection for leading a substance to be vaporized into the outer casing,
- an outlet connection for leading the vaporised substance out from the outer casing,

- a plate pack functioning as an evaporator, which is arranged inside the outer casing, in its lower part,
- an inlet connection and an outlet connection for a heating substance for leading a heating substance into the plate pack and out from it, and
- a droplet separator, which is arranged inside the outer casing, above the plate pack.

In a typical evaporator according to the invention an outlet connection for leading the vaporised substance out from the outer casing is arranged to an end plate of the outer casing, and said outlet connection is connected to a suction duct arranged inside the outer casing in a longitudinal direction of the shell, and said suction duct comprises openings at the upper surface of the suction duct, wherein the droplet separator is constructed at both sides of the suction duct.

An evaporator according to the invention is typically used as a flooded evaporator in vapor-compression refrigeration cycle in refrigerating machinery and a thereto related droplet separator. The evaporator structure according to the invention is used to ensure that no droplets are carried from the evaporator to a compressor used in a refrigerating machinery.

It has been found that the vaporised substance can be sucked out from the outer casing uniformly by arranging a suction duct in connection with the droplet separator inside the evaporator. Thus, an outlet for the vaporised substance can be arranged at an end plate of the evaporator, wherein the pipework of the evaporator and the refrigeration machine related to it can be made simpler. A structure of the evaporator according to the invention is compact, which may reduce a space required for the pipework for leading the vaporised substance out from the evaporator. In a preferred embodiment according to the invention all inlet and outlet connections of the evaporator may be arranged to an end plate of the outer casing, in the most preferred embodiment all inlet and outlet connections are arranged at the same end plate. A suction duct arranged in the droplet separator construction forms suction uniformly along the whole suction duct, wherein droplet separation is also efficient. The vaporised substance flow through the droplet separator and then it is led to the suction duct and out from the outer casing. The structure according to the invention is simple and the droplet separator with the suction duct can be arranged inside the outer casing easily as a separate component.

In an evaporator according to the present invention, a suction duct and an outlet connection for the vaporized substance can be manufactured as the standard size independent of the size of the plate pack and the capacity of the evaporator. Therefore, the structure of the present invention is also economical because the components to be used can be standard parts or otherwise widely used.

DESCRIPTION OF THE DRAWINGS

The invention is described in more detail below with reference to the enclosed schematic drawing, in which.

DETAILED DESCRIPTION OF THE INVENTION

Figure 1:
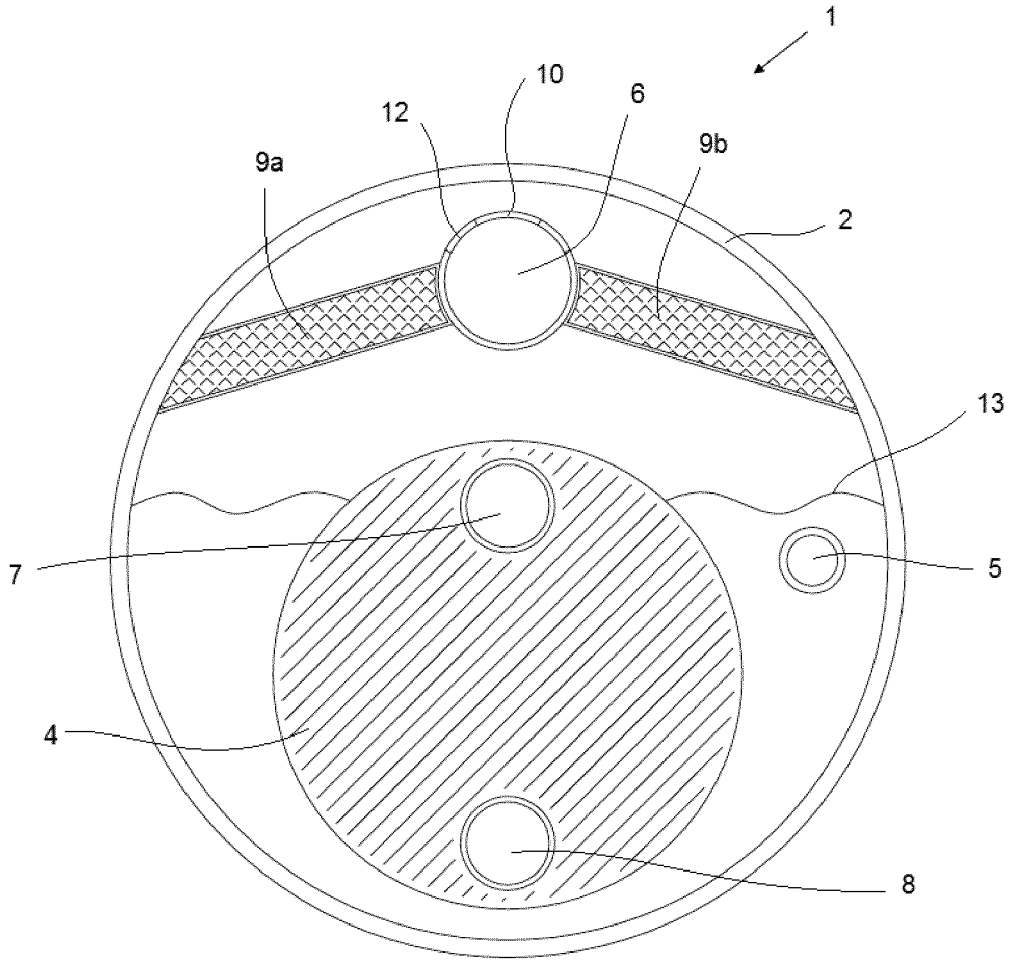
FIG. 1 shows cross-section of the evaporator according to an embodiment of the invention.

An evaporator according to the invention is based on the structure of Plate and Shell type heat exchanger. The evaporator comprises an outer casing and a plate pack arranged inside the outer casing. The outer casing comprises a substantially horizontal shell and substantially vertical first end plate and second end plate, which are arranged at the ends of the shell. In a typical embodiment the shell is a cylindrical shell. The term longitudinal direction of the outer casing or cylindrical shell used in this description typically means the horizontal direction. For example if the cylindrical shell of the outer casing is a straight circular cylinder, then its longitudinal direction is the same as the direction of the central axis of the cylinder in question.

Typically, in an evaporator according to the invention, the outer casing functions as a pressure vessel. An evaporator according to the invention is preferably a flooded evaporator.

A plate pack functioning as an evaporator is arranged inside the outer casing, in its lower part. A plate pack of the evaporator is formed by arranging plate pairs on top of each other. Each plate pair is typically formed of two heat exchange plates that are attached, preferably welded together at least at their outer periphery. Each heat exchange plate has at least two openings for the flow of a heating substance. Adjacent plate pairs are attached to each other by attaching the openings of two adjacent plate pairs to each other. Thus, a heating substance can flow from a plate pair to another via the openings. The substance to be vaporised is arranged to flow inside the outer casing in the spaces between the plate pairs. An inlet connection and an outlet connection for a heating substance for leading a heating substance into the plate pack and out from it are arranged at an end plate of the outer casing. The inlet and outlet connection for the heating substance are arranged in connection with the inner parts of the plate pack, i.e. inner parts of the plate pairs of the plate pack, whereby the primary circuit of the evaporator is formed between the inlet and outlet connection of the heating substance. The inlet and outlet connections for the substance to be vaporised are arranged through the outer casing and in connection with the inner side of the outer casing, i.e. with the outer side of the pack of plates. In other words, the secondary circuit of the evaporator is formed between the inlet and outlet connection of the substance to be vaporised, inside the outer casing, in the spaces between the plate pairs. Typically, the primary and secondary circuits are separate from each other, i.e. the heating substance flowing in the inner part of the plate pack cannot get mixed with the substance to be vaporised flowing in the outer casing. Thus, the heating substance flows in every other plate space and the substance to be vaporised flows in every other plate space of the plate pack.

A plate pack formed by heat exchange plates arranged one on top of each other is arranged inside the outer casing so that the longitudinal direction of the plate pack is the same as the longitudinal direction of the shell of the outer casing. In an embodiment according to the invention, the plate pack functioning as an evaporator is formed of circular heat exchange plates, wherein the plate pack is mainly circular cylinder in shape, in which longitudinal direction is the longitudinal direction of the cylindrical shell. A length of the plate pack in a longitudinal direction is substantially same as the length of the shell. In an embodiment of the invention the plate pack is substantially a circular cylinder, whereby the outer diameter of the plate pack is about 30-70% or about 40-60% of the inner diameter of the cylindrical shell. The plate pack is typically situated to be acentric in relation to the cylindrical shell, in the lower part of the cylindrical shell. Alternatively, a plate pack may also be formed of oval shaped or semi-circular heat exchange plates, wherein the plate pack is situated at the lower part of the outer casing and it may substantially decrease a volume of the substance to be vaporised inside the shell of the outer casing.

In an evaporator according to the invention, an inlet connection for a substance to be vaporised is typically arranged through a cylindrical shell or an end plate of the outer casing. In a preferred embodiment of the invention, an inlet connection for leading a substance to be vaporised into the outer casing is arranged to an end plate of the outer casing.

According to the present invention an outlet connection for leading the vaporised substance out from the outer casing is arranged to an end plate of the outer casing. In the present invention, an outlet connection for leading the vaporised substance out from the outer casing is connected to a suction duct arranged inside the outer casing in a longitudinal direction of the shell and said suction duct comprises openings at the upper surface of the suction duct, wherein the droplet separator is constructed at both sides of the suction duct. In an embodiment according to the invention, an evaporator may comprise two outlet connections for leading the vaporised substance out from the outer casing, which outlet connections are arranged at both ends of the suction duct and so at both end plates of the outer casing. The outlet connections at both ends of the suction duct may be advantageous when the length of the shell increases in a longitudinal direction and the efficient suction of the vaporised substance out from the outer casing and efficient droplet separation should be guaranteed.

In a preferred embodiment according to the invention, all inlet and outlet connections are arranged at an end plate of the outer casing, preferably to the same end plate for simplifying the structure of the evaporator.

A droplet separator is arranged inside the outer casing, above the plate pack. Typically, a droplet separator is arranged inside the outer casing, in its upper part. This kind of structure provides a compact structure of the evaporator. The construction of the droplet separator is not limited, but it can be selected on the basis of the operation conditions and their requirements. In an embodiment of the invention the evaporator comprises a demister droplet separator. A droplet separator according to an embodiment of the invention comprises a first and a second vapour-permeable demister part. An evaporator according to the invention comprises a suction duct arranged in connection with the outlet connection(s) for leading the vaporised substance out from the outer casing, and the suction duct is a part of the droplet separator arrangement arranged above the plate pack, at upper part of the outer casing. A first and a second demister parts of the droplet separator are arranged on both sides of the suction duct. The demister parts are tightly attached to the suction duct in a longitudinal direction of the suction duct. In a typical embodiment of the invention, the demister parts have a length substantially correspond with the length of the plate pack, and they are installed diagonally downwards from a line of the midpoint of the shell toward the edges of the outer casing.

In an embodiment of the invention, the demister parts of the droplet separator comprise two superposed perforated plates or the like, the space between which is filled with highly gas-permeable material, such as wire mesh, steel wool or the like, which generating as low a flow resistance as possible. In one embodiment of the invention the demister parts may comprise of one or several vapour permeable demister parts and vapour impermeable parts.

In an embodiment according to the invention, a suction duct arranged in connection with the outlet connection for leading the vaporised substance out from the outer casing has a length which corresponds with the length of the shell of the outer casing, i.e. the suction duct typically extends in a longitudinal direction of the horizontal shell from the first end plate to the second end plate, wherein suction can be arranged uniformly along the whole length of the shell. This provides efficient droplet separation and decreases a wetting of the droplet separator. A suction duct is arranged substantially horizontally into the outer casing.

A suction duct comprises openings at the upper surface of the suction duct through which a vaporised substance is sucked out from the interior of the outer casing. In a preferred embodiment according to the invention, a suction duct comprises openings at the upper surface of the suction duct substantially in the whole length of the suction duct. The shape and size of the openings can vary, for example the openings may be circular or oval shaped or they may be longitudinal openings. In an embodiment according to the invention, the upper surface of the suction duct may comprise longitudinal openings in the length direction of the suction duct. In another embodiment according to the invention, an upper surface of the suction duct may be perforated. In an embodiment according to the invention, a sum of the area of the openings arranged at the upper surface of the suction duct should be at least same as the area of the outlet connection(s) for leading the vaporised substance out from the evaporator for providing adequate suction.

In an embodiment of the invention, the openings of the suction duct are arranged at the upper surface of the suction duct, which surface is substantially above the demister parts of the droplet separator, i.e. the opening are substantially above the uppermost line of the demister parts of the droplet separator. This guarantee that the substance to be vaporised is led through the droplet separator prior to enter the suction duct and led out from the outer casing.

In an embodiment of the invention, a droplet separator arrangement may comprise a cover plate arranged above the demister parts of the droplet separator and the suction duct, which cover plate is inside the outer casing arranged in the longitudinal direction of the horizontal shell. In atypical embodiment according to the invention, a cover plate has a length which corresponds with the length of the demister parts and in cross-direction a cover plate is arranged to elongate from the lower edge of the first demister part to the lower edge of the second demister part. A cover plate is attached to the lower edges of the demister part. In an embodiment according to the invention, a first end plate and a second end plate are arranged at the ends of the cover plate, to which end plates are attached to the end of the demister pats for forming closed structure, which eliminates flowing of the vaporised substance directly to the suction duct, i.e. the cover plate with the end plates is used to eliminate a by-pass flow of the droplet separator.

In an embodiment according to the invention, a cover plate has a corresponding shape with the inner surface of the shell in order to arrange the cover plate and so the whole droplet arrangement close contact the inner surface of the outer casing.

According to an embodiment of the invention, a droplet separator comprising a suction duct, demister parts arranged on both side of the suction duct and a cover plate can be manufactured as a separate droplet separator component, which is arrangeable inside the outer casing. This simplifies the assembly work of the droplet separator. Typically, the droplet separator component comprises also the end plates attached to the ends of the cover plate. A suction duct is typically arranged through an end plate of the component.

In an embodiment according to the invention a length of the suction duct is increased so that it elongates through an end plate of the outer casing, preferably through both end plates, which makes possible to attach the suction duct and so the whole droplet separator structure, which comprises a suction duct, demister parts arranged on both side of the suction duct and a cover plate, to the end plates of the outer casing. Therefore, there is no need to attach a cover plate or droplet separator to the shell of the outer casing, which simplifies the assembly work. When a suction duct elongates through the end plate(s), the suction duct is also supported by the end plate.

In a flooded evaporator according to the invention, the liquid level of the substance to be vaporised, such as the refrigerant or other liquid to be vaporised, is advantageously adjusted to the level of the diameter of the cylindrical shell, whereby the surface area of the substance to be vaporised is as large as possible and the production of vapour per surface area is as small as possible. The ascension speed of the vapour is thus also as small as possible, whereby the generated droplets travelling with the vapour more easily fall back down. In an embodiment according to the invention, the liquid volume is decreased so that at least one filler unit has been fitted between the cylindrical plate pack and the cylindrical shell. Longitudinal filler units have advantageously been arranged on both side of the plate pack, which plate pack is in the longitudinal direction of the cylindrical shell. The filler units can be shaped according to need to decrease the liquid volume as much as possible.

An evaporator according to the invention may be used as a flooded evaporator of a refrigerating system and a thereto related droplet separator.

Detailed Description of the Examples of the Figures

For the sake of clarity, the same reference numbers are used for corresponding parts in different embodiments.

Figure 2:
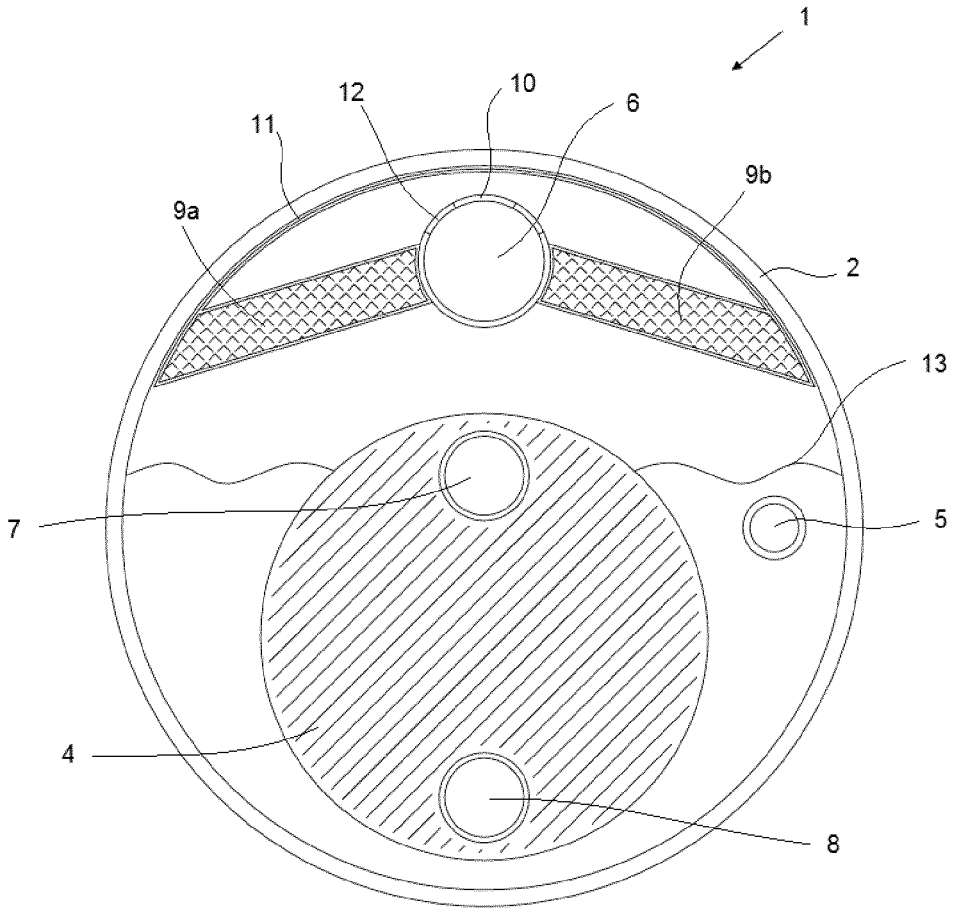
FIG. 2 shows a cross-section of the evaporator according to another embodiment of the invention.
Figure 3:
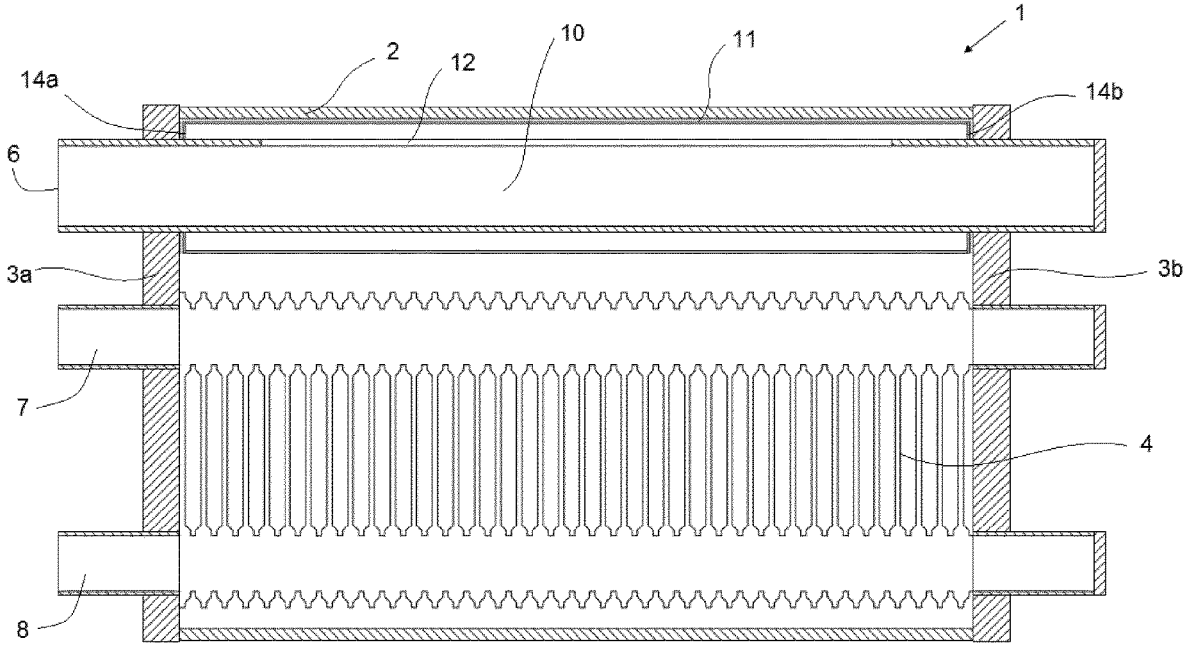
FIG. 3 shows a longitudinal cross-section of the evaporator according to an embodiment of the invention.

The evaporators 1 presented in FIGS. 1-3 comprise an outer casing, which is formed of a substantially horizontal cylindrical shell 2 and substantially vertical first and second end plates 3*a*, 3*b*. A cylindrical plate pack 4 is arranged inside the cylindrical shell in an acentric manner. The plate pack 4 is typically arranged in the lower part of the cylindrical shell and a droplet separator is arranged above the plate pack at the upper part of the cylindrical shell. The plate pack 4 presented in Figures is formed by circular heat exchange plates arranged on top of each other and the plate pack 4 is arranged inside the horizontal cylindrical shell 2 so that the longitudinal direction of the plate pack is the same as the longitudinal direction of the cylindrical shell. The outer surfaces of the plate pack 4 functions as heat exchange surfaces of the evaporator. An inlet connection 7 and an outlet connection 8 are arranged to lead a heating substance into and out from the plate pack 4, and they are arranged at an end plate 3*a*.

An inlet connection 5 for a substance to be vaporized and an outlet connection 6 for the vaporised substance are arranged at an end plate 3*a* of the outer casing.

A droplet separator arrangement comprises a suction duct 10 and demister parts 9*a*, 9*b* arranged on both sides of the suction duct. A suction duct 10 is arranged in connection with an outlet connection 6 for the vaporised substance. A suction duct 10 comprises openings 12 substantially in the whole length of the suction duct. The openings 12 are arranged at the upper surface of the suction duct, which surface is substantially above the demister parts 9*a*, 9*b* of the droplet separator. A suction duct is arranged substantially horizontally into the outer casing. As shown in FIG. 3, a suction duct may elongate through the end plates 3*a*, 3*b* of the outer casing and so it can be easily attached to the end plates. The demister parts 9*a*, 9*b* are installed approximately horizontally in the longitudinal direction of the cylindrical shell and at the same time diagonally downwards from a line of the midpoint of the cylindrical shell toward the edges of the device.

A droplet separator may further comprise a cover plate 11, as illustrated in FIG. 2. A cover plate 11 has a form of the inner surface of the shell 2. A cover plate 11 elongates from the lower edge of the demister part 9*a* to the lower edge of the demister part 9*b*. As presented in FIG. 3, a droplet separator arrangement at the upper part of the outer casing comprises also the end plates 14*a*, 14*b* arranged at the ends of the cover plate 11 and attached to the demister parts. In an embodiment presented in FIG. 4, a suction duct 10 elongates through the end plate 14*a*, 14*b*.

A substance to be vaporised, for example the refrigerant, is brought into the outer casing 2 from inlet connection 5. The vaporised substance exits from outlet connection 6. A heating substance is brought through the end plate 3*a* of the outer casing into the plate pack 4 with the inlet connection 7 and removed from the plate pack through the end plate 3*a* of the outer casing with the outlet connection 8. The outer surfaces of the plate pack 4 function as heat exchange surfaces of the evaporator. The liquid level 13 of the substance to be vaporised is drawn to be visible in FIGS. 1 and 2. The liquid level 12 of a substance to be vaporized, such as the refrigerant or other liquid to be vaporized, is advantageously adjusted to about the level of the diameter of the cylindrical shell, whereby the surface area of the substance to be vaporized is as large as possible and the production of vapour per surface area is as small as possible. The inlet connections 5 for the substance to be vaporised is placed through the end plate 3*a* of the outer casing in the embodiments presented in Figures. The placement of the inlet connection 5 is determined according to the need at any time. According to an embodiment of the invention the inlet connection for a substance to be vaporised is arranged beneath the liquid level 13.

From the liquid level 13 vapour rises up through the demister parts 9*a*, 9*b* of the droplet separator which separates fine droplets from the vapour. After passing through the droplet separator the vapour can exit through the suction duct 10 and the outlet connection 6. From there the vaporised refrigerant is led onward, for example to the compressor of a refrigerating apparatus (not shown).

The invention claimed is:

1. An evaporator for vaporizing a substance into a gaseous form thereof, wherein the evaporator comprises:

an outer casing, which comprises a substantially horizontal shell, substantially vertical first and second end plates, a suction duct arranged inside the outer casing in a longitudinal direction of the shell, the suction duct having an upper surface and openings formed in the upper surface, an inlet connection for leading a substance to be vaporized into the outer casing, an outlet connection for leading vaporized substance out from the outer casing, the outlet connection being arranged at one of the first and second end plates of the outer casing, a plate pack functioning as an evaporator, which is arranged inside the outer casing, in its lower part, an inlet connection and an outlet connection for a heating substance for leading a heating substance into the plate pack and out from it, a droplet separator is arranged inside the outer casing above the plate pack, the droplet separator comprising first and second demister parts which are arranged at both sides of and are connected to the suction duct such that the upper surface of the suction duct is positioned above the first and second demister parts, and a cover plate arranged above the first and second demister parts of the droplet separator and the suction duct, the cover plate having a length which corresponds with a length of the first and second demister parts and having an elongated cross-direction extending from a lower edge of the first demister part to a lower edge of the second demister part.

2. The evaporator according to claim 1, wherein the inlet connection is arranged at one of the first and second end plates of the outer casing.

3. The evaporator according to claim 1, wherein the suction duct extends in the longitudinal direction of the horizontal shell from the first end plate to the second end plate.

4. The evaporator according to claim 1, wherein the suction duct extends through at least one of the first and second end plates of the outer casing.

5. The evaporator according to claim 4, wherein the suction duct extends through both of the first and second end plates.

6. The evaporator according to claim 1, wherein the openings are formed in the upper surface of the suction duct substantially along an entire length of the suction duct.

7. The evaporator according to claim 1, wherein the first and second demister parts of the droplet separator comprise two superposed perforated plates defining a space therebetween which is filled with a gas-permeable material.

8. The evaporator according to claim 1, wherein the first and second demister parts have lengths substantially corresponding to a length of the plate pack, and wherein the first and second desmister parts installed diagonally downwardly from a midpoint line of the shell toward respective edges of the shell.

9. The evaporator according to claim 1, wherein the cover plate has a corresponding shape corresponding with an inner surface of the shell.

10. The evaporator according to claim 1, wherein each of the suction duct, the first and second demister parts arranged on both sides of the suction duct and the cover plate are formed as separate components arranged inside the outer casing.

11. The evaporator according to claim 1, wherein the first and second end plates are arranged at respective ends of the cover plate, and wherein the first and second demister parts are respectively attached to the first and second end plates.

12. The evaporator according to claim 1, wherein the evaporator comprises two outlet connections arranged at both ends of the suction duct for leading the vaporized substance out from the outer casing.

* * * * *